US006260397B1

(12) United States Patent
Zheng et al.

(10) Patent No.: US 6,260,397 B1
(45) Date of Patent: Jul. 17, 2001

(54) ROLLING MILL WITH ROLL DEFLECTION BI-DIMENSIONALLY CONTROLLED

(76) Inventors: Hongzhuan Zheng; Linzhen Zhao, both of Bldg. 3, No. 14. Jingqi Rd., Zhengzhou City, Henan Province 450002 (CN)

( * ) Notice: Subject to any disclaimer, the term of this patent is extended or adjusted under 35 U.S.C. 154(b) by 0 days.

(21) Appl. No.: 09/486,575

(22) PCT Filed: Sep. 4, 1997

(86) PCT No.: PCT/CN97/00091

§ 371 Date: May 10, 2000

§ 102(e) Date: May 10, 2000

(87) PCT Pub. No.: WO99/11397

PCT Pub. Date: Mar. 11, 1999

(51) Int. Cl.[7] ..... B21D 31/00
(52) U.S. Cl. ..... 72/237
(58) Field of Search ..... 72/237, 242.4, 72/241.4, 241.2, 242.2, 242.6

(56) References Cited

U.S. PATENT DOCUMENTS 5,596,899 * 1/1997 Sendzimir et al. ..... 72/242.4
5,609,054 3/1997 Ogawa et al. ..... 72/14.1
5,666,844 * 9/1997 Bieber ..... 72/242.4
5,692,407 * 12/1997 Kajiwara et al. ..... 72/241.4

FOREIGN PATENT DOCUMENTS 2045332U 10/1989 (CN) ..... B21B/1/22
1041122A 4/1990 (CN) ..... B21B/1/22
2228811Y 6/1996 (CN) ..... B21B/1/26
2250822Y 4/1997 (CN) ..... B21B/1/22
487759 6/1938 (GB) .

* cited by examiner

*Primary Examiner*—Rodney A. Butler
(74) *Attorney, Agent, or Firm*—Sheridan Ross P.C.

(57) ABSTRACT

A high-precision rolling mill with the flexture of the roll being controlled two-dimensionally which mainly comprises a mill stand, roll systems and roll supports. To minimize the flexural deformation of the rolls during rolling, the inventive rolling mill is also provided with a two-dimensional supporting system which is commonly composed of the mill stand, the roll supports and intermediate supporting means between the mill stand and the roll supports. The intermediate supporting device comprises pressing devices and horizontal pads, as well as vertical pad sets. The configuration of rolling mill results in the great reduction of the flexure, thus reducing the thickness error of cross-section of rolled plate and strip.

27 Claims, 9 Drawing Sheets

Prior Art

Prior Art

ROLLING MILL WITH ROLL DEFLECTION BI-DIMENSIONALLY CONTROLLED

FIELD OF THE INVENTION

The invention generally relates to a rolling mill for producing plate and strip, and in particular to a rolling mill in which a roll's flexure is controlled in two-dimensional directions, thereby the rolled plate and strip have very high thickness precision in cross section.

BACKGROUND OF THE INVENTION

Generally, there are a variety of kinds of rolling mills for rolling plate and strip, and they are classified according to the number of rolls into the two-high mill, the four-high mill and the cluster mill, but the most commonly used rolling mills are the four-high mill, the HC mill and the cluster mill and so on. For two-high type, four-high type mills, there exist many disadvantages, the main disadvantage is that: when a rolled piece passes the mill stand, since the pressing devices are located at the necks of the rolls, the rolls are caused to have larger bending deformation, and the deformations of the rolls will result in the thickness error in the cross section of the rolled piece (rolled plate and strip), thus seriously affecting the quality of the rolled piece. To solve the above problem, the method of increasing the diameter of the rolls has to be adopted, and for a four-high mill, also the method of increasing the diameter of the supporting rolls has to be adopted. However, as the diameter of the rolls increases, it is certain to cause the rolling forces to abruptly increase, and the change of the rolling forces in turn causes an increase of the bending deformation of the rolls.

The cluster mills include integral housing type mills and open type mills (as shown in FIGS. 1, 2), Japanese Patent 54-1259 discloses a cluster mill which adopts a tower-like roll system. Of course, such rolling mills all have the advantage of high rigidity, but in a cluster mill, the portions of the mill stand which contact the supporting rolls still have bending deformation under rolling forces, thus causing the flexural deformation of the working rolls and affecting the uniformity of the thickness of rolled piece as a result.

The solution to the problem of the roll's flexural deformation to reduce or eliminate the effect of the roll's flexural deformation on the thickness of rolled piece consists in the control of the shape of the clearance between the working rolls to make the flexural deformation of the working rolls not to be affected by the change of rolling forces. A Chinese Patent (application number 89101393, issuance number CN 1013250B) discloses "A rolling mill with rolls of small flexure and high rigidity". To achieve above object, according to the patent, the supporting rolls at the outmost layer of the tower-like roll system are supported on the roll supports in the form of a mufti-section beam; rolling forces acting on the working rolls are transmitted respectively to the upper and lower roll supports via the roll systems; the vertical component of the force borne by the roll supports are transmitted to the mill stand via the downward acting or upward devices or similar elements such as pads; the number of the downward acting or upward acting devices is at least two, and the positions of the downward acting or upward acting devices are in the middle region of the axis of the working roll on the roll supports. It can be seen, the solution of that patent can make the flexural deformation of the roll supports in the vertical plane substantially not to vary with the rolling forces, thus effectively reducing the thickness error in the cross-section of the rolled piece. However, for the cluster mills with a tower-like roll system, the force transmitted from the working rolls to the intermediate rolls has vertical and horizontal components, therefore the peripheral supporting rolls also bear significant horizontal component force. For the rolling mill disclosed in Chinese Patent No. 89101393, the horizontal component force causes the roll supports to have horizontal flexural deformation, thus causing the intermediate rolls as well as the working rolls to have larger flexural deformation.

As stated above, for solving the problem of flexural deformation of the working rolls of a cluster mill, it is not only necessary to reduce the flexural deformation produced by the vertical component force, but also that produced by the horizontal component force, that is, it is obliged to solve the problem of deformation in two-dimensional directions, so that a working roll can be held straight and the thickness precision in the cross-section of the rolled piece is increased.

SUMMARY OF THE INVENTION

Therefore, the invention is aimed to solve the problem of the two-dimensional flexural deformation of the rolls, namely, the invention can reduce not only the flexural deformation in vertical direction, but also that in horizontal direction. Accordingly, the object of the invention is to provide a high-precision rolling mill, as compared with the prior art, when the rolling mill of the invention is subjected to the rolling force, the flexural deformation of the rolls can be greatly reduced, resulting in the reduction of the thickness error in the cross-section of the rolled piece and the increase of the dimension accuracy of the rolled piece.

To achieve the above-mentioned object, the embodiment of the invention is as follows: the rolling mill for rolling plate and strip comprises a mill stand, an upper and a lower roll systems and an upper and a lower roll supports. The mill stand is of a frame shape and is able to bear rolling forces, and all parts and components of the rolling mill, such as the roll systems, are incorporated in the frame. The roll system is so arranged as to be of a tower-like configuration. The roll system is composed of three parts, a working roll, supporting rolls and intermediate rolls; the upper and lower supporting rolls disposed at the outmost layer of the roll system are respectively supported on the upper and lower roll supports in the form of a mufti-section beam, and the upper roll support can be moved up and down if necessary to adjust the magnitude of the clearance between the rolls. The rolling mill is characterized in that the mill stand, the roll supports and the intermediate supporting means between the frame and the roll supports commonly compose a two-dimensional supporting system. The intermediate supporting means is disposed on at least one of the upper and lower roll supports and is arranged in the region of the middle part of the roll body axis of the working roll with its length being not longer than the length of the roll body of the working roll. The intermediate supporting means includes pressing devices and horizontal pads; there are at least two pressing devices disposed above the upper roll support and placed in the mill stand, the lower roll support is supported by horizontal pads, and both the pressing devices and the horizontal pads are arranged in the region of the middle part of the roll body axis of the working roll on the roll support. In the invention there are also disposed upper and lower vertical pad sets along a horizontal direction, which are respectively positioned between the two side walls of the upper and lower roll supports and supported on the side walls of the mill stand, and the upper and lower vertical pad sets are respectively composed of two wedge-shaped menders to prevent the flexural deformation due to the horizontal component force. The shape of the mill stand is mated with that of the roll supports.

BRIEF DESCRIPTION OF THE DRAWINGS

The embodiments of the invention will be described in detail in connection with accompanying drawings, and the object of the invention will become more apparent from the following description.

DETAILED DESCRIPTION OF THE PREFERRED EMBODIMENTS

Figure 1:
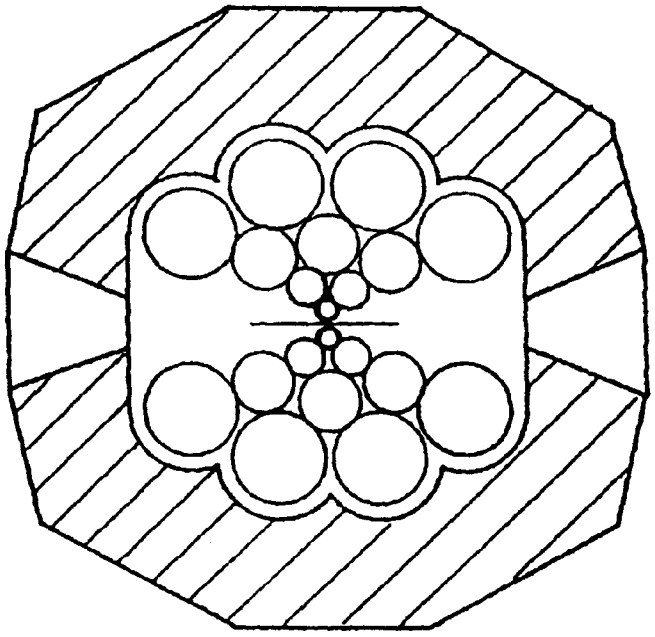
Fig. 1 Prior Art
FIG. 1 is a schematic view of a conventional rolling mill.
Figure 2:
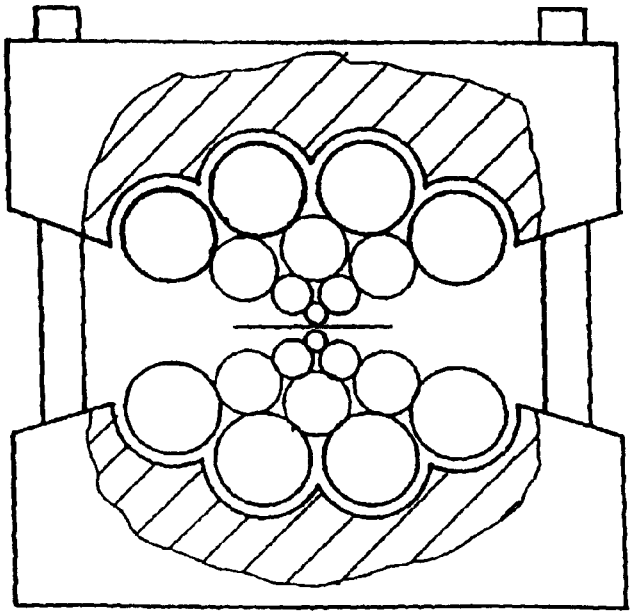
FIG. 2 is a schematic view of a conventional open type cluster mill.
Figure 3:
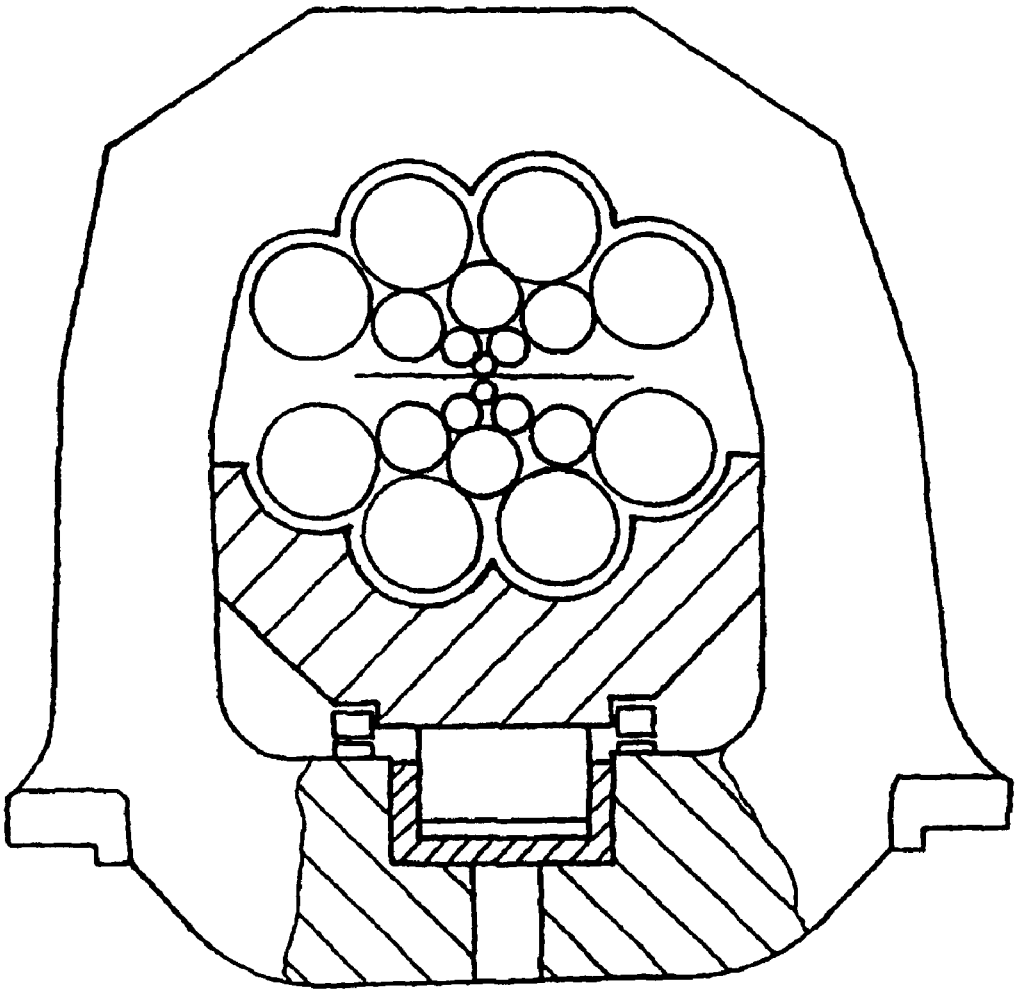
FIG. 3 is a schematic view of a conventional cluster mill disclosed in a Japanese Patent.

FIGS. 1–3 are schematic views showing the commonly used conventional rolling mills. Due to their structure, it is inevitable for the rolls to deflect during rolling, and this will directly affect the quality of the rolled piece. Therefore, the surface precision of rolled piece, especially the thickness precision of plate, can not meet the requirements.

Figure 4:
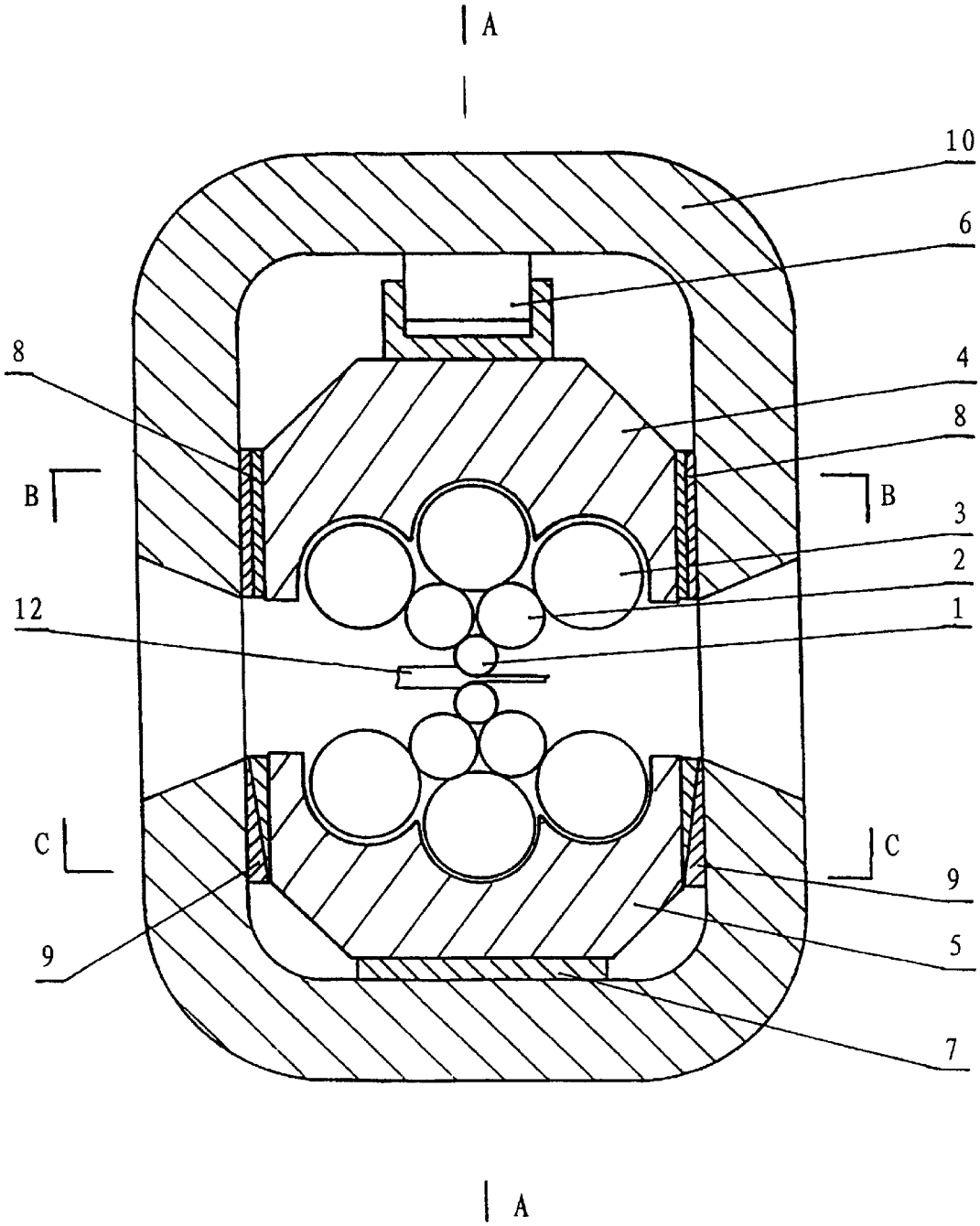
FIG. 4 is a front sectional view of the first embodiment of the rolling mill in accordance with the invention.
Figure 5:
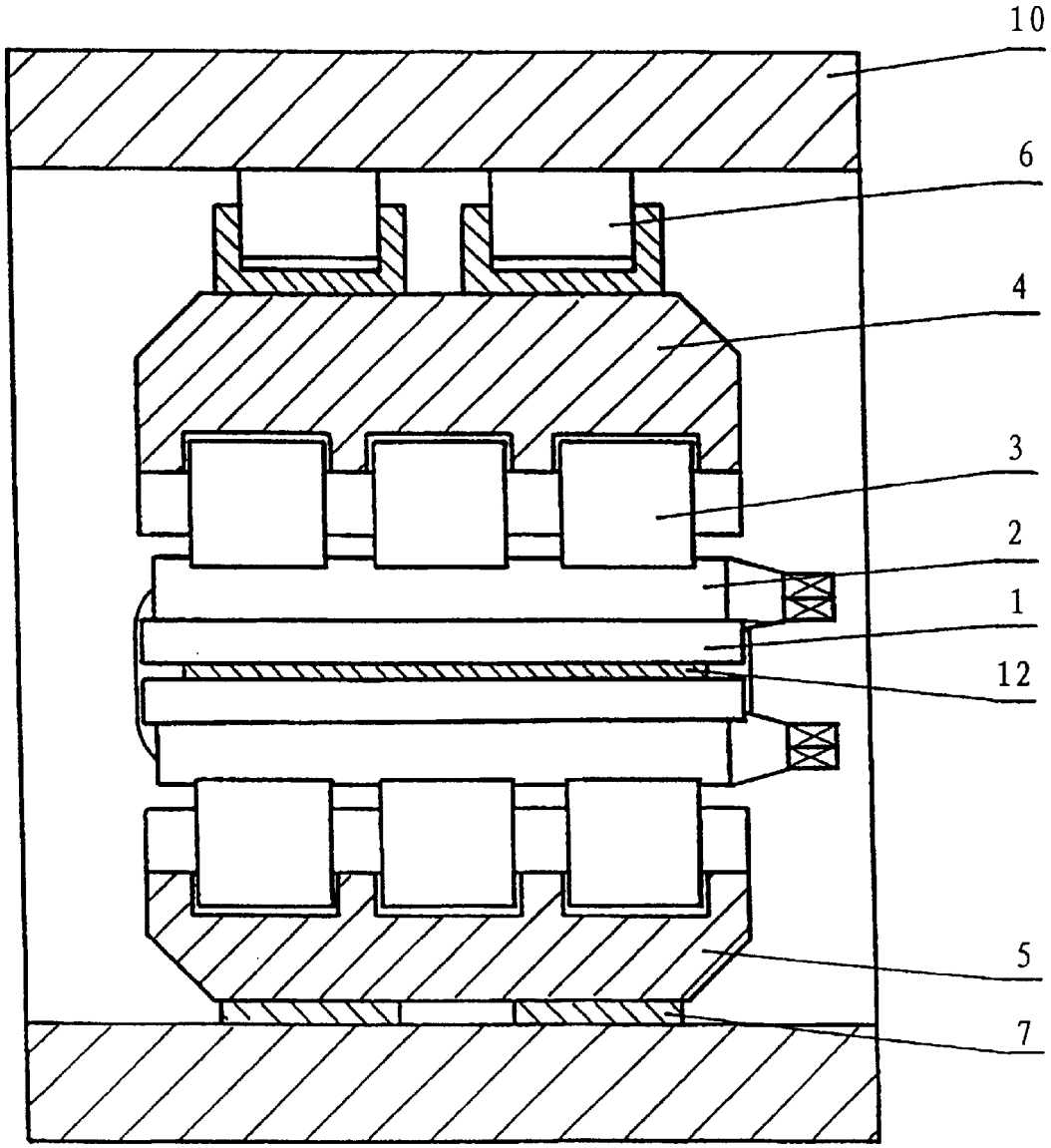
FIG. 5 is a sectional view of the first embodiment of the invention taken along line A—A in FIG. 4.

FIGS. 4–7 show the first embodiment of the high-precision rolling mill with flexures being controlled two-dimensionally in accordance with the invention. As can be seen in FIG. 4, a two-dimensional supporting system comprises a frame 10, roll supports 4, 5, and intermediate supporting means provided between the frame and the roll supports. In the frame 10 there are provided the main parts and components such as upper and lower roll systems, upper and lower roll supports, and etc. The frame 10 can be formed into an integral one, or can be formed by several parts connected together by means of welding or other connecting methods. The upper and lower roll systems are respectively composed of a working roll 1, intermediate rolls 2 and supporting rolls 3 which form a tower-like roll system together. The rolled piece is designated by 12. The supporting rolls 3 at the outmost layer of the roll system are supported in the form of a mufti-section beam, generally two or more section beam (refer to FIG. 5), on the upper and lower roll supports 4 and 5. In the intermediate supporting means, the pressing devices 6 are provided between the upper roll support 4 and the upper inner wall of the frame 10, the devices 6 are installed on the roll support 4 and located at the middle region of the axis of the working roll, generally located within the length of the roll body of the working roll. The pressing devices 6 can move up and down, causing the upper roll support 4 to move up and down in the integral frame 10 to adjust the clearance between the rolls. For carrying out automatic control, the pressing devices can also be equipped with an automatic sheet thickness controlling device (not shown in the figures) so as to accurately detect the magnitude of the rolling force and the clearance between the rolls. Therefore, the production can be automated to obtain high precision products.

Between the lower roll support 5 and the lower inner wall of the frame 10 there are disposed horizontal pads 7 (FIG. 4), the horizontal pads are placed under the roll support and located at the middle region of the axis of the working roll, generally located within the length of the roll body of the working roll. Obviously, the lower roll support 5 is supported by the horizontal pads 7. The horizontal pads 7 can be of different sizes, namely, the thickness of the horizontal pads can form a thickness series. The adjustment of the rolling line can be realized by using horizontal pads 7 with different thickness. And also, the horizontal pads 7 can be replaced by a hydraulic device or a screw device.

Figure 6:
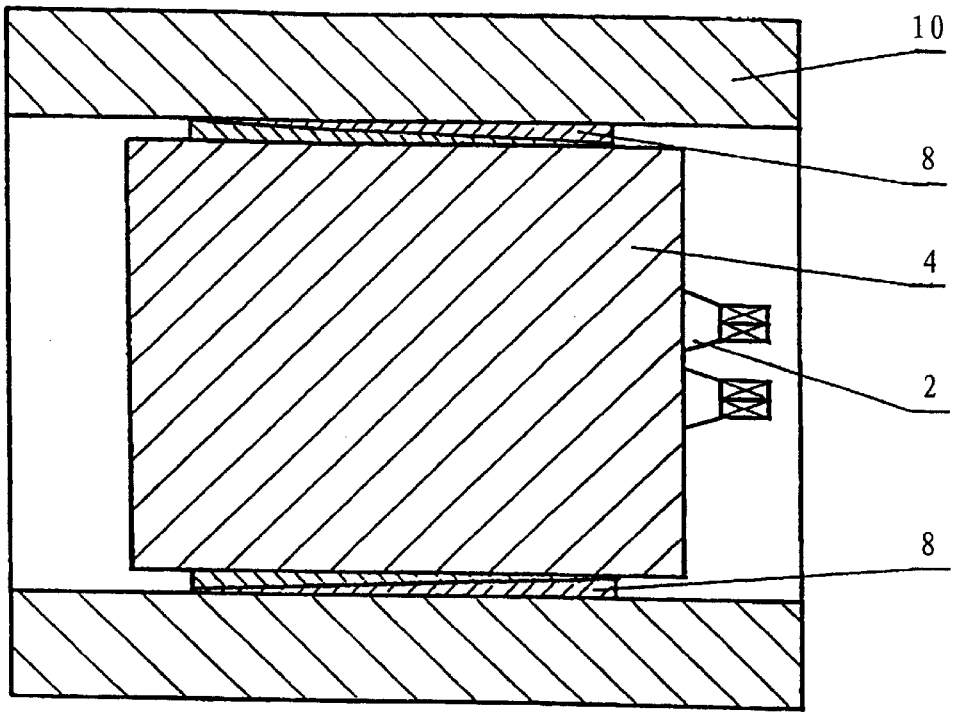
FIG. 6 is a sectional view of the first embodiment of the invention taken along line B—B in FIG. 4.
Figure 7:
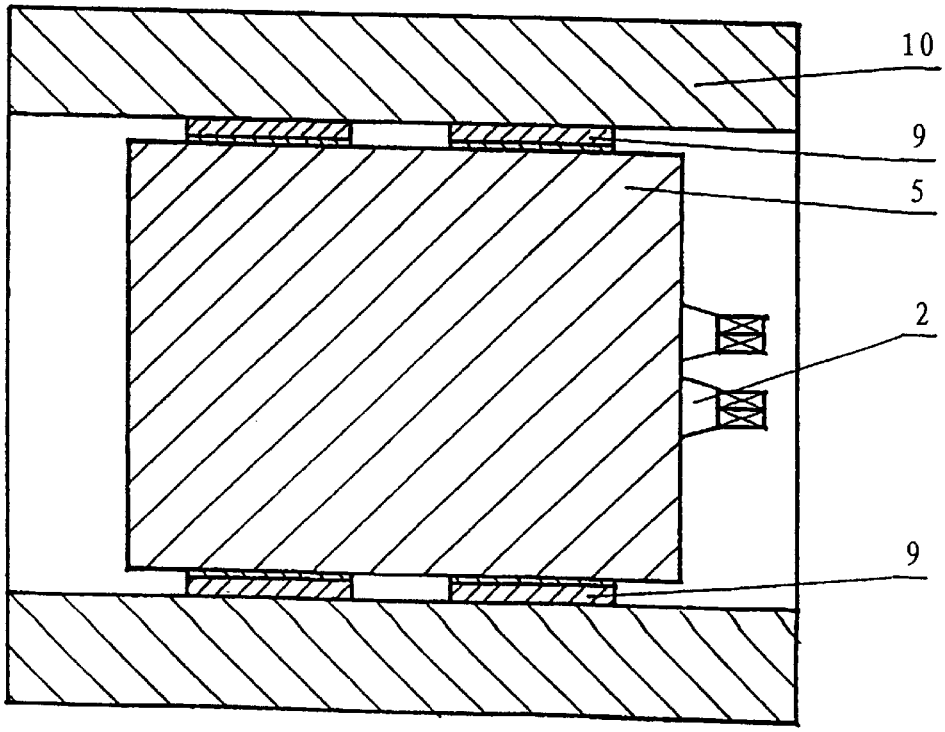
FIG. 7 is a sectional view of the first embodiment of the invention taken along line C—C in FIG. 4.

Referring to FIGS. 4, 6 and 7, it can be clearly seen from FIG. 4 that, besides being supported vertically by the pressing devices 6, the upper roll support 4 is supported horizontally by two pairs of upper vertical pad sets 8, 8. which are disposed between the inner side wall of the frame 10 and the upper roll support 4. The upper vertical pad sets 8, 8 are respectively on the left side and the right side of the upper roll support 4, and located at the middle region of the axis of the working roll, being within the length of the roll body. The upper vertical pad sets 8 each is composed of two mating wedge-shaped members with opposite inclinations (refer to FIG. 6). Similarly, the lower roll support 5 is not only supported vertically by the horizontal pads 7, but also supported horizontally by lower vertical pad sets 9, 9 which are disposed between the inner side walls of the frame 10 and the lower roll support 5. The lower vertical pad sets 9, 9 are respectively on the left side and the right side of the lower roll support 5, and located at the middle region of the axis of the working roll, being within the length of the roll body. The lower vertical pad set 9 is also composed of mating wedge-shaped members (see FIG. 7). The lower roll support 5, together with the horizontal pads 7 and the lower vertical pad sets 9, is supported on the frame 10, and the upper roll support 4, together with the upper vertical pad sets 8 and the pressing devices 6, is supported on the frame 10.

Due to the above-mentioned structure of the rolling mill of the invention, the flexures of the rolls are substantially reduced. This is because that the frame, the roll supports and the intermediate supporting means between the frame and the roll supports of the rolling mill form a two-dimensional supporting system together, namely providing support in both vertical and horizontal directions, and specifically, the upper and lower roll supports, the supporting rolls, intermediate rolls and working rolls are all supported in both horizontal and vertical directions. The rolling forces borne by the working rolls are transmitted to the supporting rolls through the working rolls and the intermediate rolls. The supporting rolls comprise several backing bearings mounted on an axle (refer to FIG. 5). Therefore, the outer ring of the bearings rotates when the rolling force is transmitted to the outer ring, and the rolling force is then transmitted to the upper roll support through the bearings. The vertical component force finally reaches the upper inner wall of the frame via the pressing devices, and the horizontal component force reaches the side walls of the frame via the vertical pad sets. Similarly, the rolling force borne by the working roll is transmitted to the lower roll support via the intermediate rolls and the supporting rolls, with the vertical component force being transmitted to the lower inner wall of the frame via the horizontal pads 7 and the horizontal component force being transmitted to the side walls of the frame via the vertical pad sets 9. The pressing devices, the horizontal pads and the vertical pad sets on the force transmitting path are all located at the middle region of the axis of the working roll, being within the length of the roll body.

Therefore, the rolling mill of the invention guarantees the proper shape, namely, the linearity of the generating line of the working roll not only in the vertical plane but also in the horizontal plane, as a result, the flexural deformation of the working roll basically does not vary with the rolling force. Therefore, the roll's flexural deformation is significantly reduced, resulting in the reduction of the error in thickness of the rolled strips.

The adjustment of the clearance between the rolls is accomplished by moving the upper roll support 4 up and down in the windows of the frame 10, the upper roll support is driven by the pressing devices.

The rolling mill of the embodiment can be placed upside down, and accordingly the pressing devices become upward acting devices. Such a modification may have the same effects.

The hydraulic pressing devices can also be replaced by a screw device.

Figure 8:
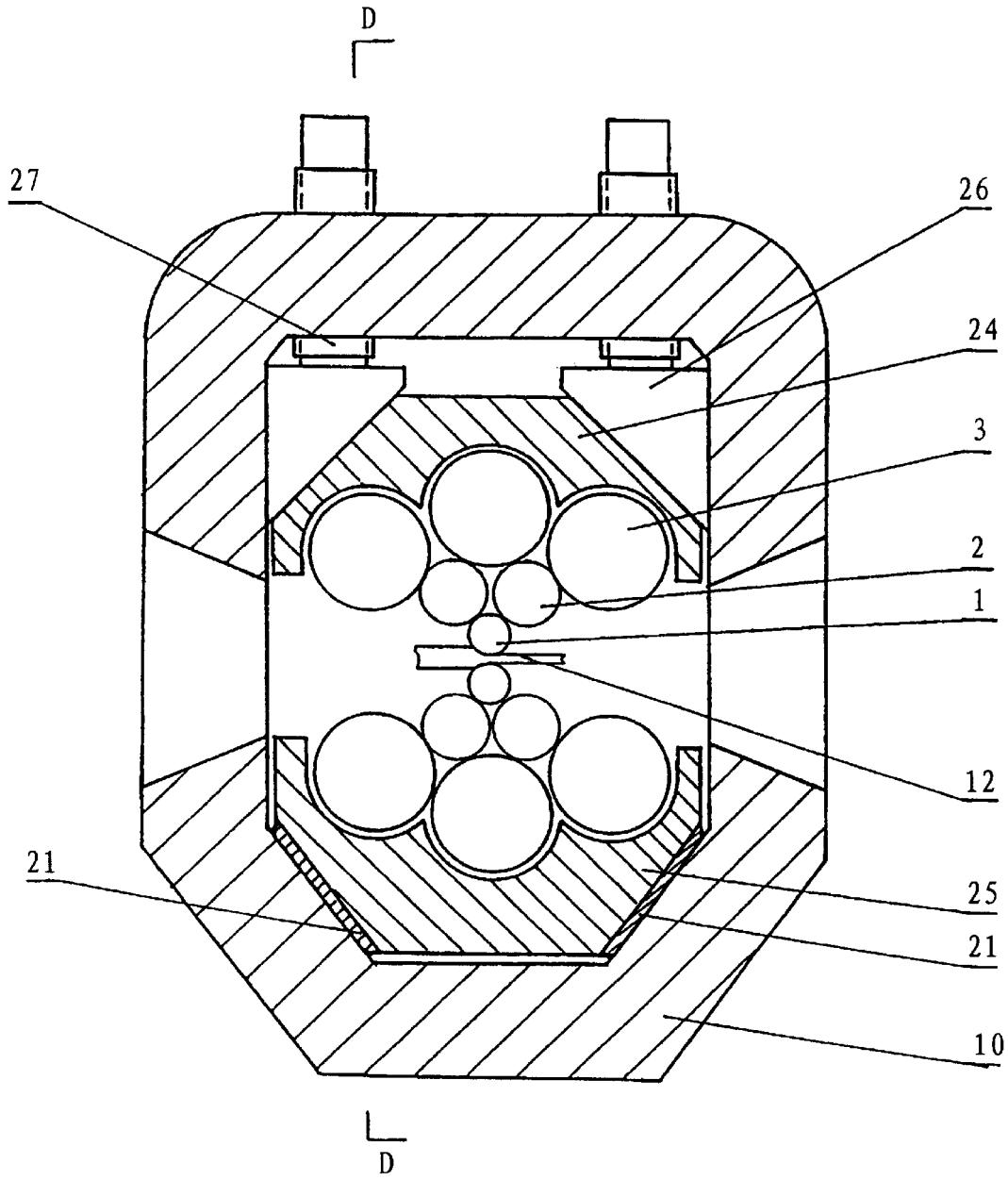
FIG. 8 is a front sectional view of the second embodiment of the rolling mill in accordance with the invention.
Figure 9:
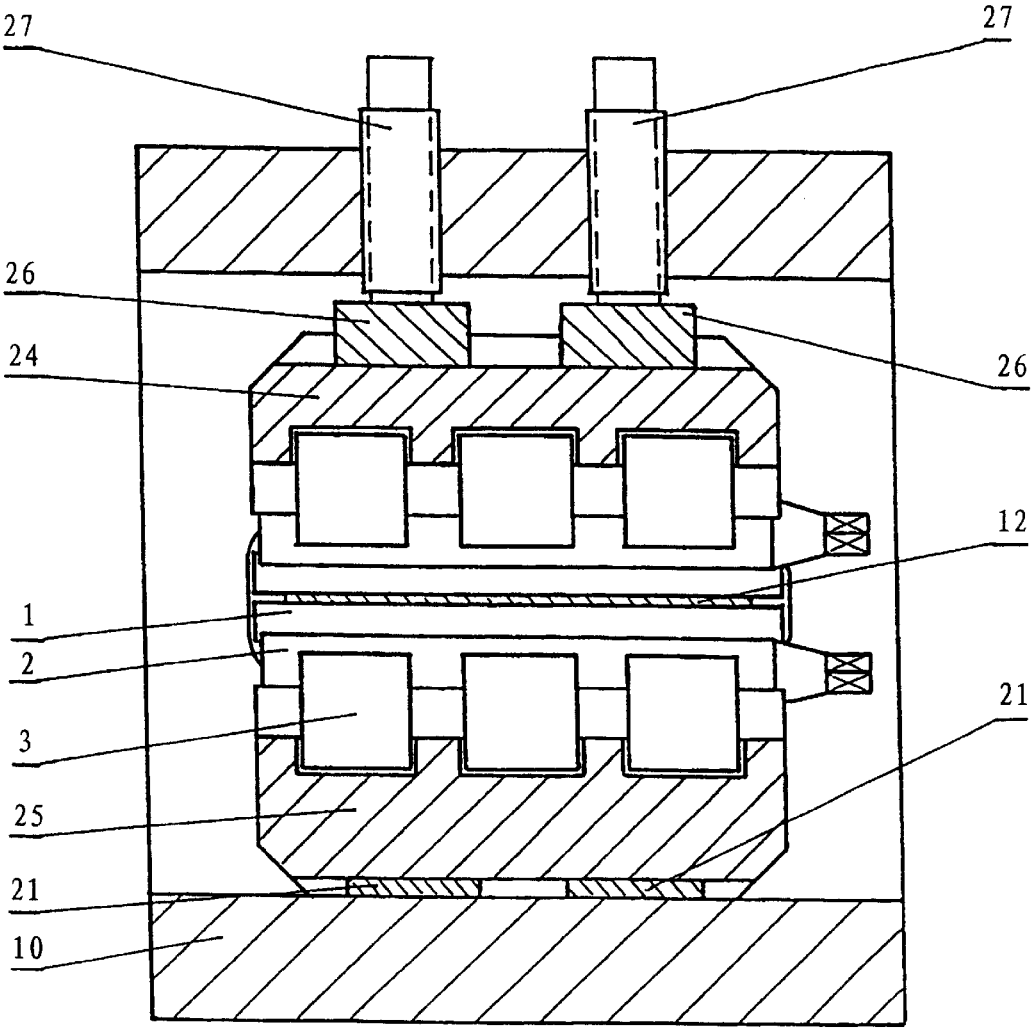
FIG. 9 is a sectional view of the second embodiment of the invention taken along line D—D in FIG. 8.

FIGS. 8–9 show the second embodiment of the invention. The rolling mill also comprise a two-dimensional supporting system composed of a mill stand, roll supports and intermediate supporting means between the mill stand and the roll supports. The particular components comprise the frame 10, the upper roll support 24, the lower roll support 25, pads 21 and the roll systems, each of the roll systems includes a working roll 1, intermediate rolls 2 and supporting rolls 3. As in the first embodiment, the roll system also forms a tower-like roll system, and the supporting rolls 3 at the outmost layer are also respectively supported on the roll supports 24 and 25 in the form of multi-section beams. The second embodiment differs from the first embodiment in that: in the intermediate supporting means, there are provided pressing devices 26, 27 in place of the pressing devices 6 and the upper vertical pad sets 8 in the first embodiment, and lower pads 21 in place of the horizontal pads 7 and lower vertical pad sets 9. This will be specifically described in the following.

Referring to FIG. 8, it can be seen from the figure that the lower roll support 25 is supported on the frame 10 through two pads 21 which are arranged obliquely between the frame 10 and the lower roll support 25, the outer side walls of the upper and lower roll supports respectively have an oblique surface formed thereon, the oblique surface inclines inwardly and meets the respective top surface. The upper roll support 24 is supported on the frame 10 through the pressing devices 26, 27 which, as shown in the figure, are obviously composed of screws 27 and pads 26. The pressing devices are disposed symmetrically on the roll support 24 (refer to FIG. 9). Each pad 26, when viewed from the front, has an oblique surface which match one of the oblique surfaces on the upper roll support 24. The threads on a pair of screws 27 are used for adjustment, it can be seen from the figure that they can move the upper roll support 24 up and down, thus causing the roll system to move up and down to adjust the clearance between the rolls. When the rolling resultant force including horizontal and vertical component forces acts on the upper roll support 24, the force is transmitted to the screw-pad sets 26, 27 and finally reaches the frame 10; the shape of the frame 10 should match with that of the roll supports 25, 24. Since the upper roll support 24 and the lower roll support 25 have oblique supporting surfaces, the frame 10 can bear the horizontal force and the vertical force. The pressing devices 26, 27 and the pads 21 on the force transmitting path are all located in the middle region of the axis of the working roll, being within the length of the roll body of the working roll, therefore, the flexural deformations of the frame in both directions can be converted into the quasi-rigid displacement of the components from the roll supports up to the working rolls. As a result, the two dimensional supporting system reduces the flexural deformation of the working rolls. FIG. 9 is a sectional view taken along line D—D in FIG. 8. The structure of the second embodiment and the shapes of the various components are clearly shown in FIG. 8 and FIG. 9. In addition, the number of the pressing devices can be more than two.

The rolling mill of the embodiment can be placed upside down, and the same effects can be obtained.

The screw device in the embodiment can be replaced by hydraulic cylinders or the like.

Figure 10:
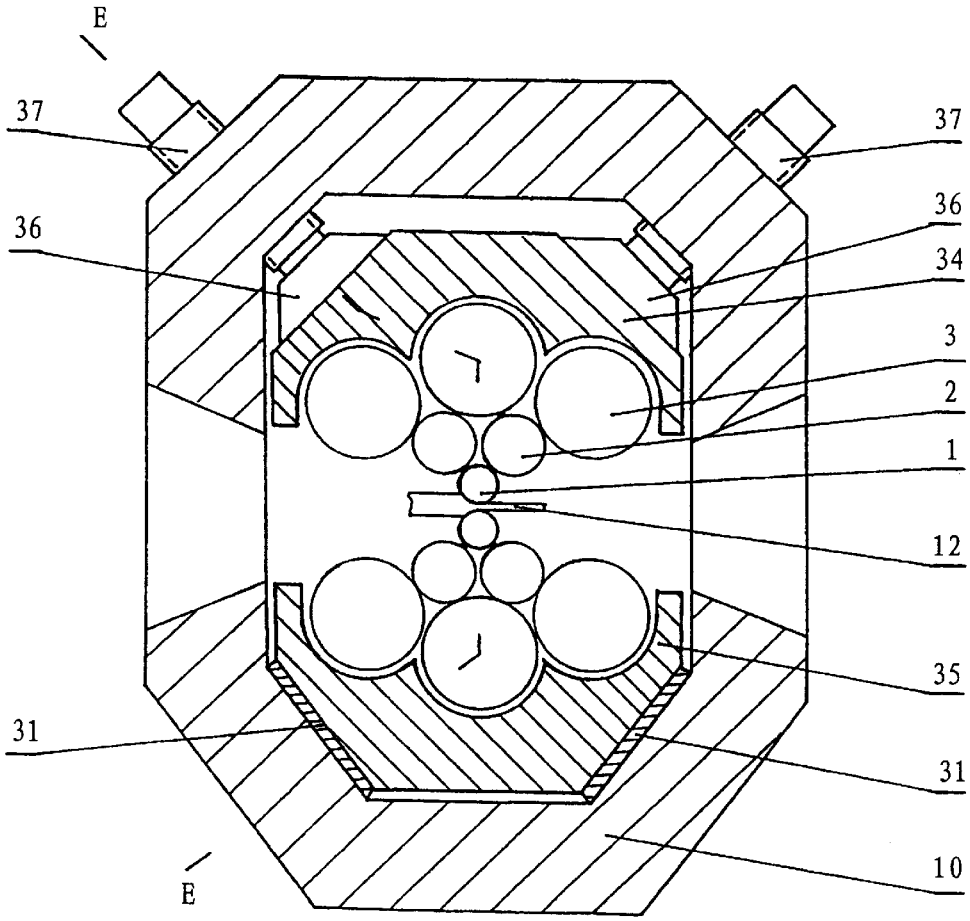
FIG. 10 is a front sectional view of the third embodiment of the invention.
Figure 11:
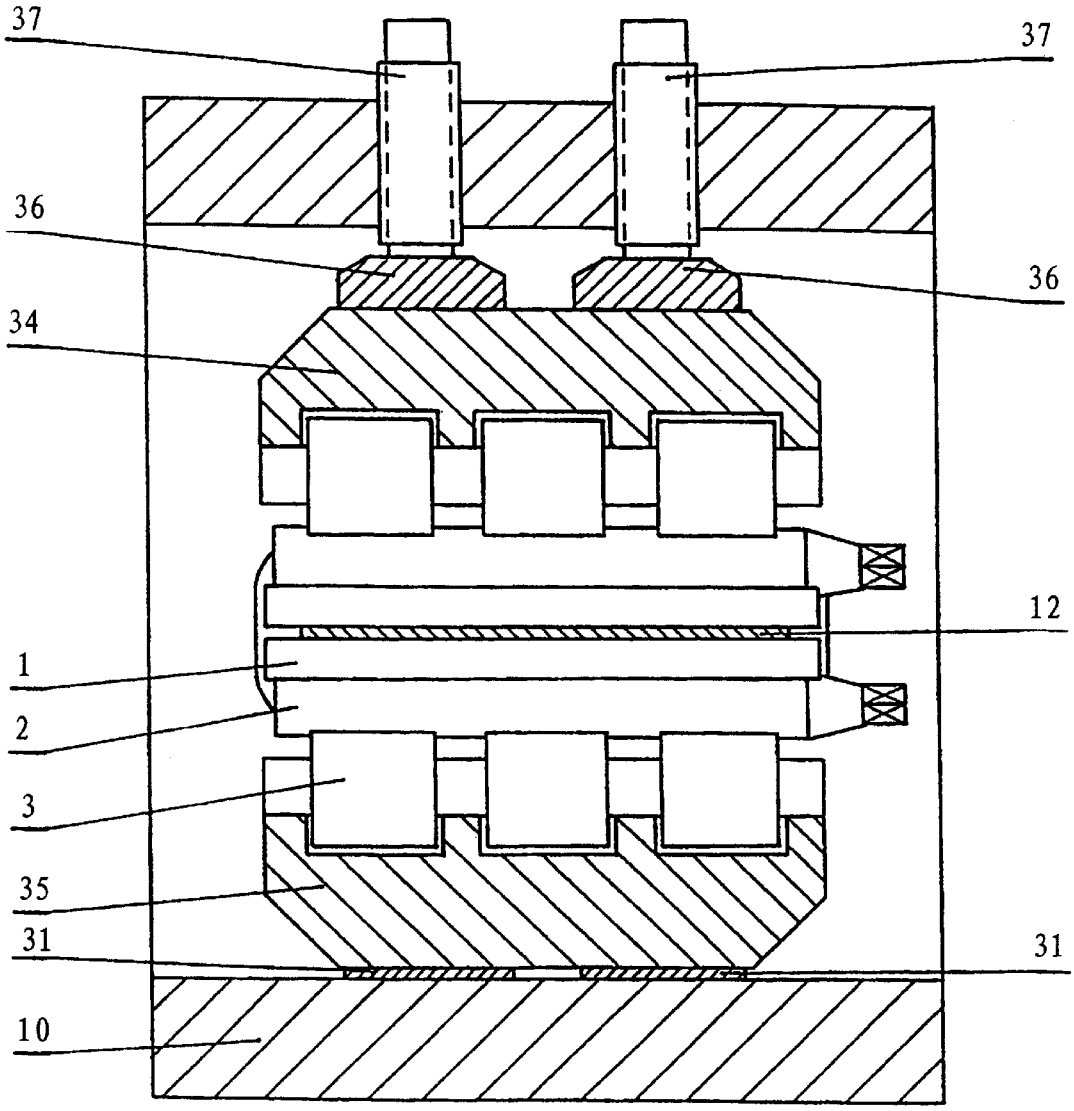
FIG. 11 is a sectional view of the third embodiment taken along line E—E in FIG. 10.

FIGS. 10 and 11 are schematic views of the third embodiment. It can be seen from the figures that the lower roll support 35 and lower pads 31 have the same structures as those in the second embodiment. The difference between them lies in the arrangement of the pressing devices 36, 37. The pressing devices 36, 37 are installed obliquely with respect to the central axis of the frame 10 at the upper surface of the frame 10 and are arranged oppositely, thus causing the arrangement of the whole rolling mill to be more rational.

In the third embodiment, the transmission of the rolling forces borne by the rolling mill and the force-bearing members of the vertical and horizontal component forces are the same as those in the second embodiment, and the principles and functions of the two-dimensional supporting system to reduce the flexural deformation of the working rolls are also substantially the same, and this will not be repeatedly described herein.

Compared with the prior art, the invention has the following advantages:

Since the rolling mill of the invention has an integral frame the shape of which corresponds to the shape of the roll supports and the frame is of very high rigidity; the pads between the roll supports and the frame or the clearance adjusting devices are located in the middle region of the axis of the working roll within the range of length of the roll body of the working roll, and composes a two-dimensional supporting system, thus, the shape of the generating line of the working rolls is guaranteed not only in the vertical plane but also in the horizontal plane. As a result, the bending deformation of the working rolls basically does not vary with the rolling force, resulting in the remarkable reduction of the thickness error of the rolled strips.

The rolling mill of the invention can simplify the design of the roll shape (cambering) and the control of the roll shape during rolling. The bending deformations of the working rolls of the inventive rolling mill occurred in horizontal and vertical directions do not vary with the rolling forces. Since among the various factors associated with the cambering such as the bending deformation, flattening deformation, heat expansion and wear etc., the most important one—bending deformation—can be left out of consideration and the heat expansion and wear are also slowly changing factors, the design of the roll shape and the control of the roll shape during rolling can be greatly simplified. In addition, the "roll pass" formed by the bending deformations of the two working rolls in a conventional rolling mill is eliminated, thus facilitating the transverse flow of the metal and being advantageous to roll high-precision strips with wedge-shaped blanks, and the phenomenon of the "edge attenuation" of strips is greatly improved.

In the above mentioned embodiments of the invention, the number of the rolls in the roll system is 12, but the roll systems may have different number of rolls. In addition, the different roll supports can mate with each other, and can also mate with the roll supports or the roll systems in a conventional rolling mill.

The invention is not limited to cold rolling mills, and is also applicable to hot-rolling mills for rolling strips.

Although the preferred embodiments of the invention have been described, to persons skilled in the art, various modifications can be made to the invention without going beyond the scope of the attached claims of the invention.

What is claimed is:

1. A rolling mill for rolling plate or strip comprising essentially a mill stand, an upper roll system and a lower roll system, and an upper roll support and a lower roll support, said upper and lower roll systems are so arranged as to have a tower-like configuration, wherein the mill stand, the roll supports, and intermediate supporting means between the mill stand and the roll supports of the rolling mill form a two-dimensional supporting system together, the intermediate supporting means being disposed on at least one of the upper and lower roll supports and arranged in the middle region of the axis of the roll body of a working roll with its length not longer than that of the roll body of the working roll, said intermediate supporting means comprising vertical pad sets which are respectively positioned between said surfaces of the roll supports and fit tightly against them, thus causing said mill stand to form a two-dimensional support relative to the roll supports.

2. A rolling mill as claimed in claim 1, wherein said intermediate supporting means further comprises pressing devices and horizontal pads, the pressing devices and the horizontal pads are respectively mounted between the upper and lower inner walls of mill stand and the end surfaces of the roll supports.

3. A rolling mill as claimed in claim 1, wherein said mill stand is an integral casting frame, or the mill stand is assembled to be an integral one by connecting methods such as welding, with windows formed in its outer walls.

4. A rolling mill as claimed in claim 1, wherein supporting rolls are arranged at the outermost layer of said roll systems, the supporting rolls being in the form of a multi-section beam generally with more than two sections.

5. A rolling mill as claimed in claim 2, wherein said pressing device is capable of vertically moving the roll support up and down along a central axis of the mill stand so as to adjust the clearance between the rolls.

6. A rolling mill as claimed in claim 1, wherein said vertical pad sets are composed of two pairs of wedge-shaped members, the mating surfaces of each pair of wedge-shaped members fit tightly against each other.

7. A rolling mill as claimed in claim 1, wherein said intermediate supporting means comprises pressing devices and pads which are respectively disposed between the inner walls of the mill stand and the roll supports.

8. A rolling mill as claimed in claim 1, wherein two outer side walls of each of said roll supports respectively have an oblique surface formed thereon which inclines inwardly and meets the respective top surface.

9. A rolling mill as claimed in claim 7, wherein said pressing devices are screw-pad sets which include a screw and a pad.

10. A rolling mill as claimed in claim 9, wherein said pads have an oblique surface which match the corresponding oblique surface on the roll supports inclining inwardly.

11. A rolling mill as claimed in claim 7, wherein said pads fit tightly against the lower oblique inner surfaces of the mill stand and the oblique surfaces of the roll supports.

12. A rolling mill as claimed in claim 9, wherein a plurality of said screw-pad sets are arranged in parallel with the central axis of the mill stand and are uniformly distributed on both sides of the central axis.

13. A rolling mill as claimed in claim 9, wherein said screw-pad sets are arranged obliquely and symmetrically relative to the central axis of the mill stand.

14. A rolling mill as claimed in claim 2, wherein said pressing devices and screws consist of hydraulic cylinders.

15. A rolling mill for rolling plate or strip comprising essentially a mill stand, an upper roll system and a lower roll system, and an upper roll support and a lower roll support, said upper and lower roll systems are so arranged as to have a tower-like configuration, wherein the mill stand, the roll supports, and intermediate supporting means between the mill stand and the roll supports of the rolling mill form a two-dimensional supporting system together, the intermediate supporting means being disposed on at least one of the upper and lower roll supports and arranged in the middle region of the axis of the roll body of a working roll with its length not longer than that of the roll body of the working roll, said intermediate supporting means comprising pressing devices and pads which are respectively disposed between the inner walls of the mill stand and the roll supports, said pressing devices comprising screw-pad sets which include a screw and a pad, said pads having an oblique surface which match a corresponding oblique surface on the roll supports inclining inwardly.

16. A rolling mill as claimed in claim 15, wherein said pads fit tightly against lower oblique inner surfaces of the mill stand and the oblique surfaces of the roll supports.

17. A rolling mill as claimed in claim 15, wherein a plurality of said screw-pad sets are arranged in parallel with the central axis of the mill stand and are uniformly distributed on both sides of the central axis.

18. A rolling mill as claimed in claim 15, wherein said screw-pad sets are arranged obliquely and symmetrically relative to a central axis of the mill stand.

19. A rolling mill as claimed in claim 15, wherein said pressing devices and screws comprise hydraulic cylinders.

20. A rolling mill for rolling plate or strip comprising essentially a mill stand, an upper roll system and a lower roll system, and an upper roll support and a lower roll support, said upper and lower roll systems are so arranged as to have a tower-like configuration, wherein the mill stand, the roll supports, and intermediate supporting means between the mill stand and the roll supports of the rolling mill form a two-dimensional supporting system together, the intermediate supporting means being disposed on at least one of the upper and lower roll supports and arranged in the middle region of the axis of the roll body of a working roll with its length not longer than that of the roll body of the working roll, said intermediate supporting means comprising pressing devices and pads which are respectively disposed between the inner walls of the mill stand and the roll supports, wherein said pads fit tightly against lower oblique inner surfaces of the mill stand and oblique surfaces of the roll supports.

21. A rolling mill as claimed in claim 20, wherein said pressing devices are screw-pad sets which include a screw and a pad.

22. A rolling mill as claimed in claim 21, wherein said pads have an oblique surface which match the corresponding oblique surface on the roll supports inclining inwardly.

23. A rolling mill as claimed in claim 21, wherein a plurality of said screw-pad sets are arranged in parallel with the central axis of the mill stand and are uniformly distributed on both sides of the central axis.

24. A rolling mill as claimed in claim 21, wherein said screw-pad sets are arranged obliquely and symmetrically relative to a central axis of the mill stand.

25. A rolling mill as claimed in claim 19, wherein said pressing devices and screws comprise hydraulic cylinders.

26. A rolling mill for rolling plate or strip comprising essentially a mill stand, an upper roll system and a lower roll system, and an upper roll support and a lower roll support, said upper and lower roll systems arranged to provide a tower-like configuration, wherein said mill stand, said roll supports, and an intermediate supporting means between said mill stand and said roll supports of the rolling mill form a two-dimensional supporting system further comprising:

means for providing support relative to said roll supports a first direction, and means for providing support relative to said roll supports in a second direction, wherein said first direction is perpendicular to said second direction.

27. A rolling mill as claimed in claim 22, wherein said means for providing support in said first direction and said means for providing support in said second direction are provided in an integral structure.

* * * * *

UNITED STATES PATENT AND TRADEMARK OFFICE

CERTIFICATE OF CORRECTION

PATENT NO. : 6,260,397 B1
DATED : July 17, 2001
INVENTOR(S) : Zheng et al.

It is certified that error appears in the above-identified patent and that said Letters Patent is hereby corrected as shown below:

Column 7,
Line 15, delete "said" and replace with -- inner side walls of the mill stand and side --.

Signed and Sealed this

Twelfth Day of April, 2005

JON W. DUDAS
*Director of the United States Patent and Trademark Office*